United States Patent [19]

Bonsch

[11] 3,985,074

[45] Oct. 12, 1976

[54] OFFSET PRINTING MACHINES

[75] Inventor: François Henry Rudolphe Bonsch, Le Vesinet, France

[73] Assignee: Roneo Vickers Limited, Croydon, England

[22] Filed: May 1, 1975

[21] Appl. No.: 573,758

Related U.S. Application Data

[63] Continuation-in-part of Ser. No. 363,886, May 25, 1973, abandoned.

[30] Foreign Application Priority Data

May 23, 1972 United Kingdom ..... 24274/72

[52] U.S. Cl. ..... 101/410; 101/246; 271/277

[51] Int. Cl.[2] ..... B41F 1/30; B41F 21/04

[58] Field of Search ..... 101/408, 409, 410, 246; 271/226, 241, 247, 277, 82

[56] References Cited

UNITED STATES PATENTS 3,125,022 3/1964 Reinhartz et al. ..... 101/410 X 3,431,843 3/1969 Kangko et al. ..... 101/409 X 3,534,683 10/1970 Barthel ..... 101/410 X

*Primary Examiner*—E. H. Eickholt

*Assistant Examiner*—Paul J. Hirsch

*Attorney, Agent, or Firm*—Wigman & Cohen

[57] ABSTRACT

A rotary printing machine including an impression cylinder which has at least two grippers for gripping the forward edge of a sheet of paper for drawing the paper onto the same at each appropriate instant in each cycle of operation of the machine, the grippers being movable circumferentially of the impression cylinder and retainable in a different position which is stationary relative to the impression cylinder, to vary the relative position of the sheet of paper on the cylinder while the cylinder is rotating.

13 Claims, 6 Drawing Figures

OFFSET PRINTING MACHINES

CROSS-REFERENCE TO COPENDING APPLICATION

This application is a continuation-in-part of my application Ser. No. 363,886, filed May 25, 1973, now abandoned.

BACKGROUND OF THE INVENTION

The invention relates to rotary printing machines, and is particularly, but not exclusively, applicable to offset printing machines of the kind having three main cylinders, namely a master cylinder, a blanket cylinder and an impression cylinder, which latter cylinder may be referred to as a paper cylinder; however, the invention could also be applied to for instance a direct offset printing machine, printing direct from the master directly onto the paper, or to a letter press.

In a conventional offset printing machine there are three main cylinders, a master cylinder which holds the master from which copies are to be made, a blanket cylinder which has a rubber blanket which receives an impression from the master cylinder for transfer to the paper, and an impression cylinder which holds a sheet of paper for receipt of the transferred impression from the blanket.

In such a conventional machine, the impression cylinder is provided with two or more grippers spaced in line across the cylinder and which have jaws which open at the appropriate moment to receive and grip the leading edge of a piece of paper carried forward and into contact with the grippers at the required instant in the cycle of operation of the machine.

It is a disadvantage of such a conventional machine that in order to change the position in which, in a longitudinal direction, the impression is received upon each piece of paper, it is necessary to stop the machine and to adjust the position of the grippers relative to the impression on the blanket, which is time consuming and which may result in adjustment in several steps being necessary before a satisfactory positioning of the impression is obtained. Particularly is this so when a subsequent impression has to be precisely positioned relative to a previous impression.

The object of the invention is to provide a rotary printing machine having means for varying the position of an impression on the sheets of paper while the machine is in operation.

THE INVENTION

In general terms, the invention provides at least two grippers on the impression cylinder for gripping the forward edge of a sheet of paper for drawing the paper onto the impression cylinder at each appropriate instant in each cycle of operation of the machine, the grippers being mounted upon support means upon the impression cylinder, which support means can be moved circumferentially of the impression cylinder and retained in a different position which is stationary relative to the impression cylinder, to vary the relative position of the sheet of paper and the impression cylinder while the impression cylinder is rotating, and thereby to adjust the position of the impression provided on the paper in the direction of motion of the paper around the axis of the impression cylinder.

Further objects, preferred features and advantages of the invention will be apparent from the following description.

BRIEF DESCRIPTION OF THE DRAWINGS

An embodiment of the invention is shown, by way of example, in the accompanying drawings, in which.

DETAILED DESCRIPTION OF ONE EMBODIMENT OF THE INVENTION

Figure 1:
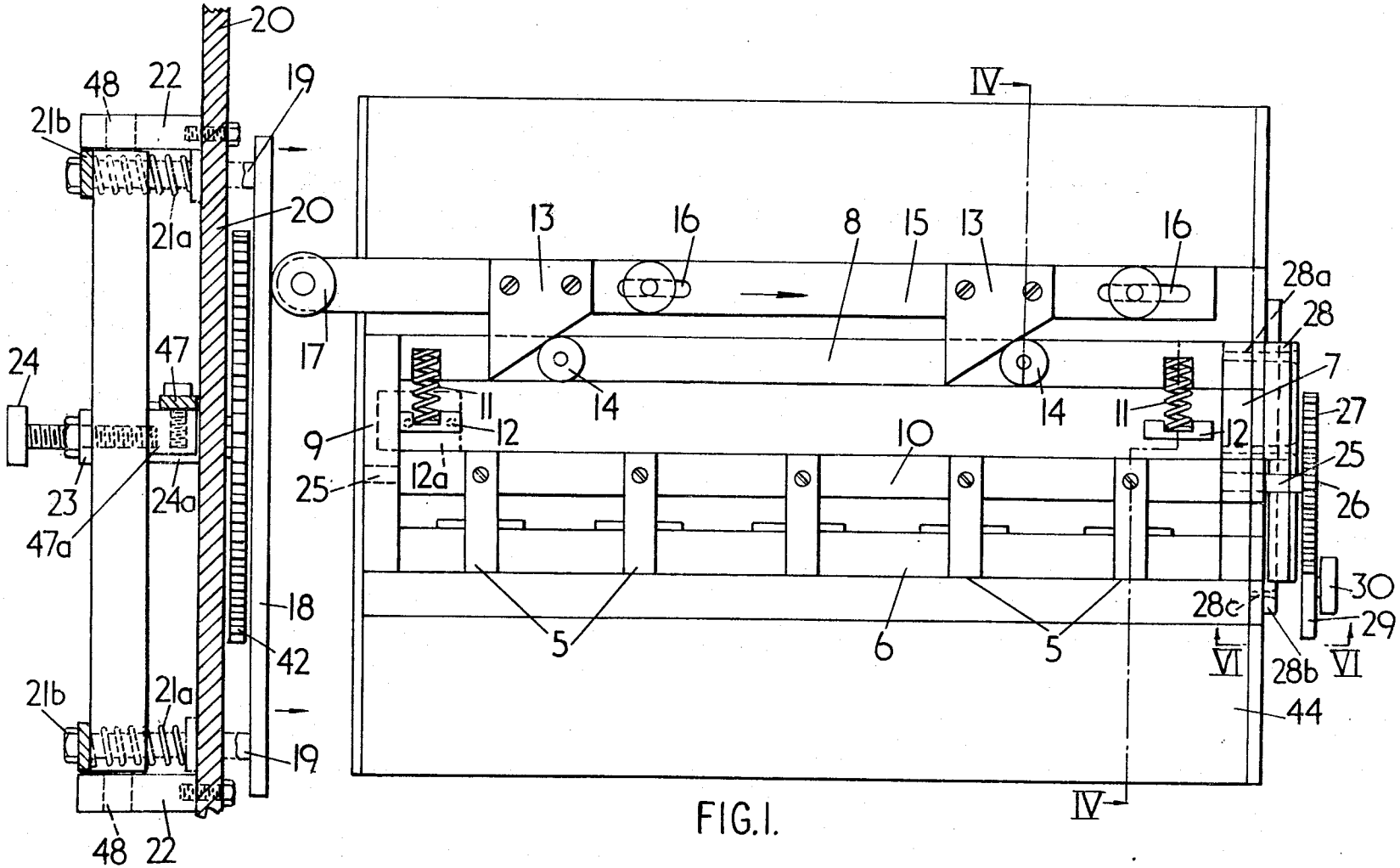
FIG. 1 is a plan of the impression cylinder, showing paper grippers positioned on top of the impression cylinder, the left-hand side of FIG. 1 being in section along the line I—I of FIGS. 2 and 3.

The rotary printing machine shown in the drawings is an offset printing machine of a known kind having a master cylinder and a blanket cylinder (forming impression transferring means), and an impression cylinder which holds a sheet of paper for the receipt of an impression transferred thereto from a master on the master cylinder by a blanket on the blanket cylinder, but the master cylinder and blanket cylinder, as well as other parts of the printing machine, are not shown, as they are unnecessary for the understanding of the invention, except to say that in the machine illustrated the blanket cylinder is mounted immediately above the impression cylinder 44 and in contact with paper thereon in the conventional manner, and is geared thereto to rotate in synchronism therewith. On referring to FIG. 4 it may be seen that the paper 1 is fed to the impression cylinder 44 from the right in the direction of the arrow by feed means to be described hereinafter, and leaves the impression cylinder 44 on the left under the roller 2 and between the rollers 3 and 4.

Figure 4:
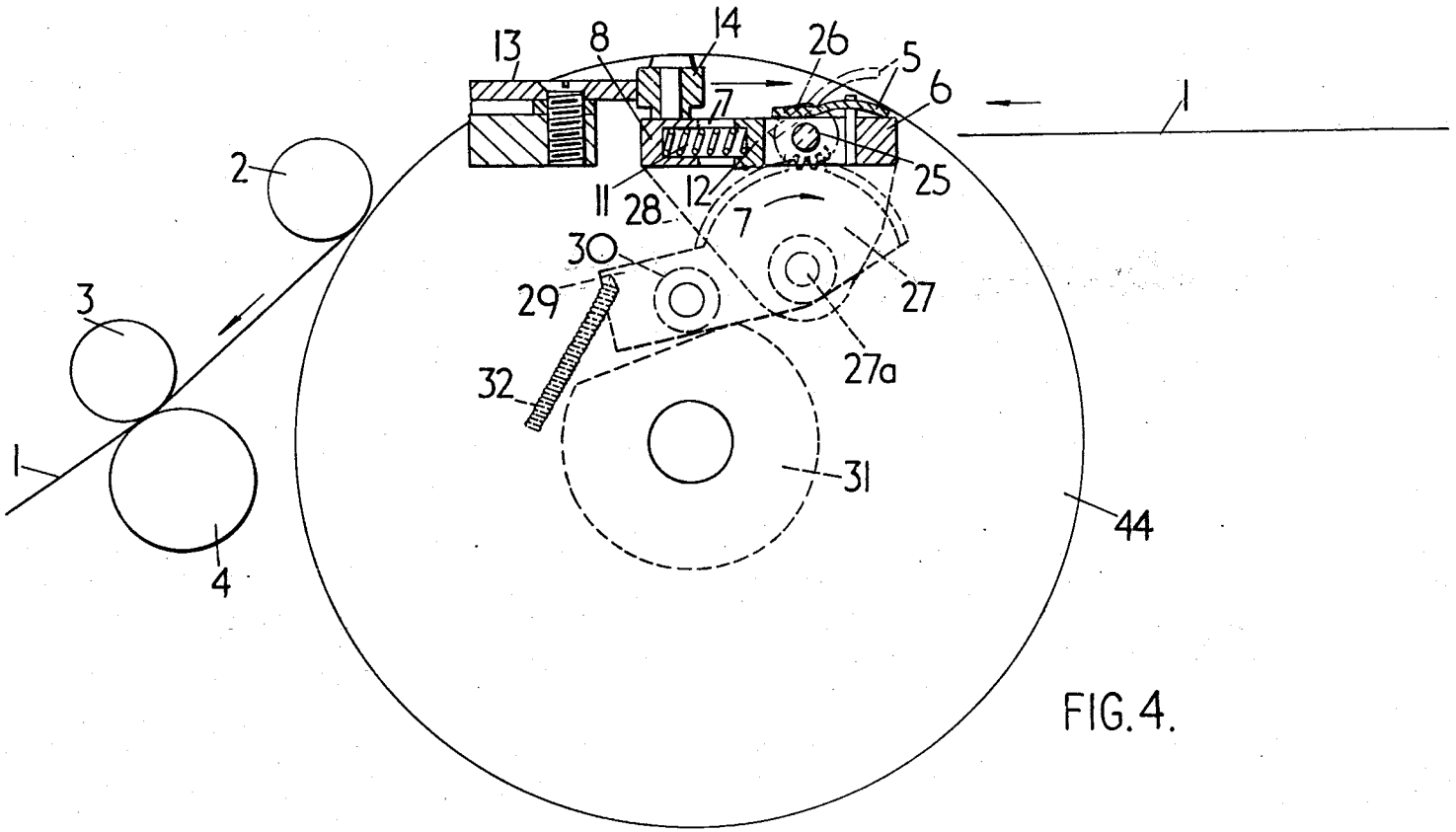
FIG. 4 is a vertical section through the impression cylinder, taken along the line IV—IV in FIG. 1.

From FIGS. 1 and 4 it can be seen that grippers 5, of which there are five in the embodiment illustrated, are mounted upon a carriage or support means comprising a frame formed of members 6, 7, 8, 9 and 10; the grippers 5 cannot be moved relative to one another. The carriage is movable circumferentially of the impression cylinder 44 against the action of two springs 11, which rest against abutment members 12 fixed on the impression cylinder 44. The carriage is movable by a a pair of cams 13, acting upon rollers 14 on the frame member 8. A bar 15 carrying the cam 13 is slotted at 16 so as to be slidable longitudinally in the direction of the arrow to move the grippers 5 in the direction from which the paper is fed to the impression cylinder 44. Reverse movement of the bar 15 allows the grippers 5 to be withdrawn under the action of the springs 11.

Upon one end of the bar 15 is mounted a roller 17, which rests on a non-rotatable pressure plate 18, supported on a pair of pins 19 positioned for sliding movement in bores in an end plate 20 of the machine, against the action of springs 21*a*. The position of the grippers 5 on the impression cylinder 44 depends on the position of the pressure plate 18 relative to the end plate 20, but once the position of the grippers 5 has been adjusted, the grippers 5 are retained in a new position which is stationary relative to the impression cylinder 44. On referring to FIGS. 2 and 3, it may be seen that there is provided a U-shaped adjustment member having a base 21 which is pivotable about the axis of the base 21 (i.e., about an axis in a plane normal to the axis of the impression cylinder 44) upon brackets 22 fastened to the end plate 20, and arms 21*b* which engage the ends of the pins 19. A lever 23 is secured to the base 21 and is provided with an adjustable screw 24 which engages an abutment member 24*a* and with which the angle of tilt of the arms of the U-shaped member 21, 21*b* can be adjusted to vary the position of the grippers 5 and hence the position of the paper relative to the impression cylinder 44 and the position of the imprint received from the blanket on the paper.

Figure 5:
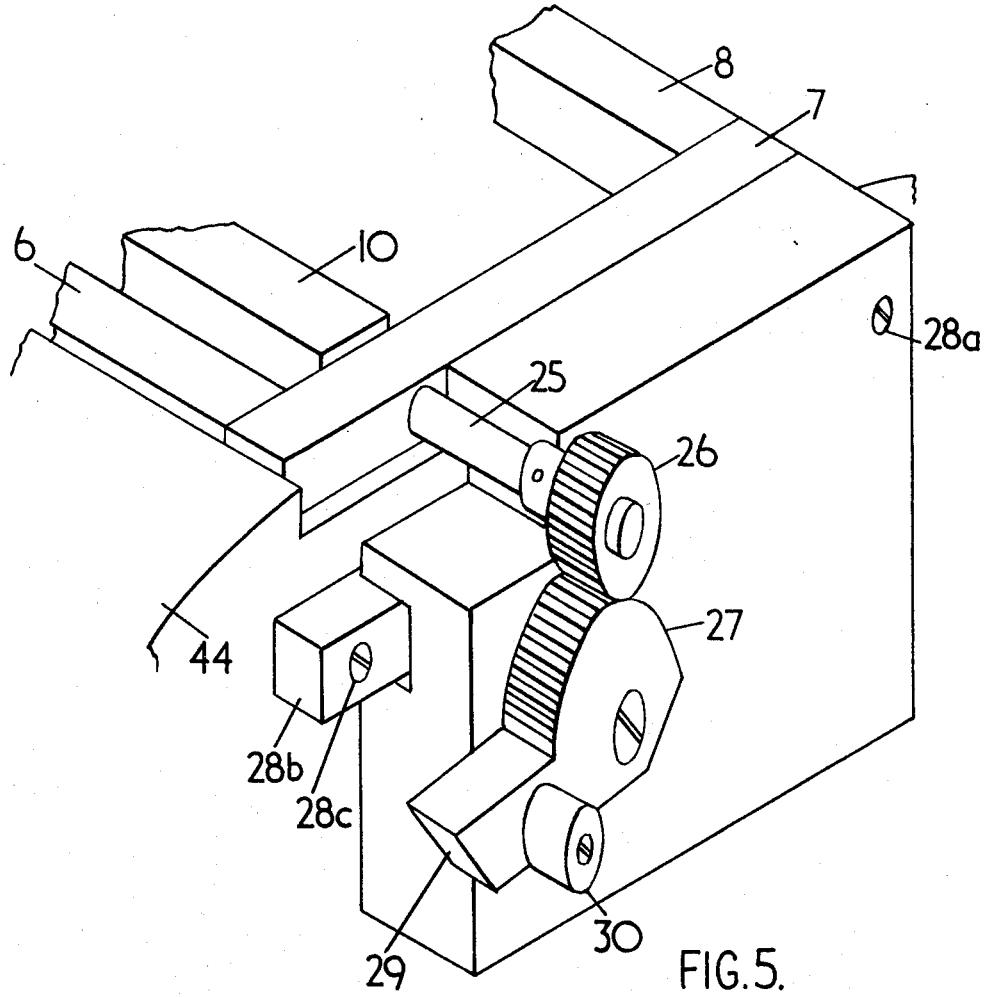
FIG. 5 is a perspective view of the right-hand side of the impression cylinder of FIG. 1, showing the right-hand end of the gripper mounting frame.
Figure 6:
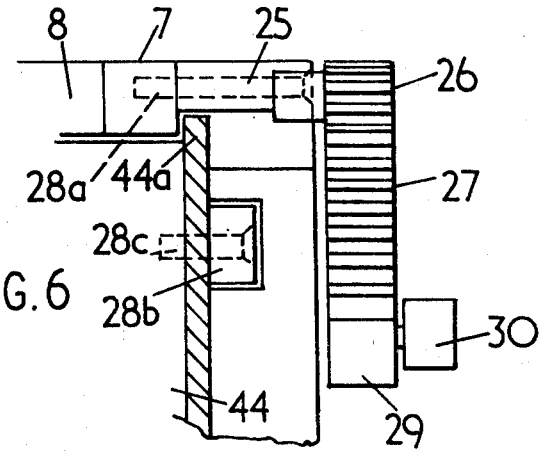
FIG. 6 is a section along the line VI—VI in FIG. 1, the impression cylinder being shown schematically.

The grippers 5 are each fastened to a frame bar 10 (see FIG. 1) which has a spindle 25 at each end passing through frame members 7 and 9 respectively and about the axis of which the bar 10 rotates to open and close the grippers 5. The spindle 25 at one end of the bar 10 is provided with a pinion 26 which meshes with a quadrant or sector gear 27 (see FIGS. 4, 5 and 6, neither the spindle 25 nor the pinion 26 being shown in FIG. 6) pivoted on a block at one end of the impression cylinder for movement about a pivot axis 27*a* (see FIG. 4), and having an extension 29 with a cam follower roller 30 which engages a cam 31 (not shown in FIG. 1, but see FIG. 4) fixed upon the opposite end plate (not shown) to the end plate 20, under the action of the spring 32. The block 28 is secured to the frame member 7 by screws 28*a* (see FIGS. 1, 5 and 6) and slides upon a slide 28*b* which is secured to the respective end wall of the impression cylinder 44 by screws 28*c* (one of which can be seen in FIG. 5). The block 28 and the frame member 7 form a slot in which engages a guide lip 44*a* (see FIG. 6) which is part of the end disk (not shown in detail) of the impression cylinder 44. The left-hand end of the frame is retained in position by a plate 12*a* which is screwed to the top of the left-hand abutment member 12 (see FIG. 1) and engages the top of the frame member 9.

As the impression cylinder 44 rotates, the roller 30 enters the flat on the cam 31 at the appropriate position of the impression cylinder 44 so that the spring 32 pulls the sector gear 27 anti-clockwise (as seen in FIG. 4), and, by way of the pinion 26, holds the grippers 5 closed during the period that the leading end of the paper 1 passes between the blanket cylinder and the impression cylinder 44. During the remainder of each revolution, the sector gear 27 is swung into its most clockwise position (as seen in FIG. 4) and the grippers 5 remain open.

Figure 3:
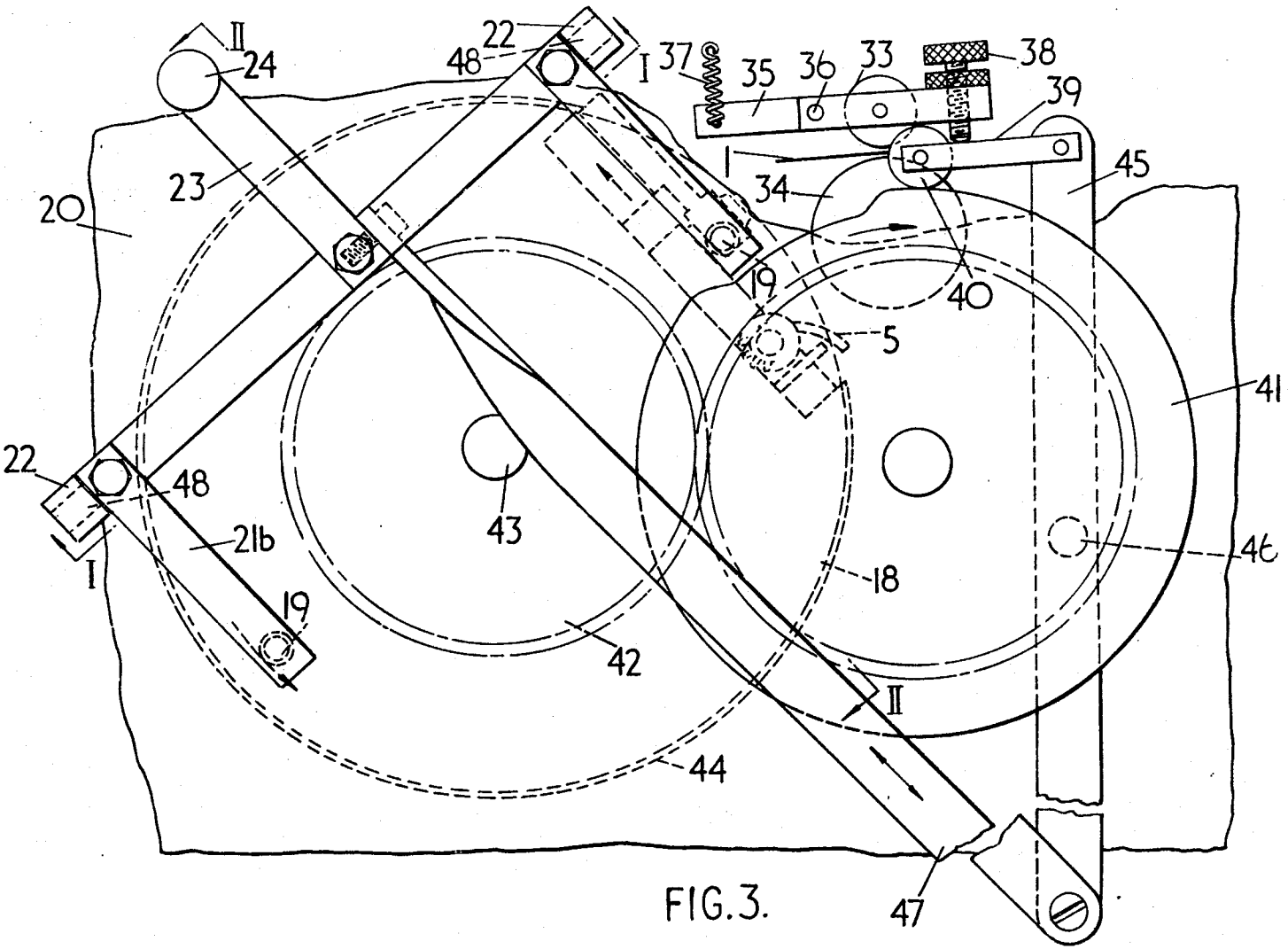
FIG. 3 is an elevation of part of the left-hand end of the machine (as seen in FIG. 1), showing the adjusting member and associated parts, and also the paper feed device.

By referring to FIG. 3, it may be seen that the paper 1 passes to the impression cylinder between a pair of rollers 33 and 34 which form a feed device. Each end of the roller 33 is supported upon a respective lever 35 pivoted at 36, the roller 33 being urged downwards by a spring 37. One of the levers 35 has an adjusting screw 38 which bears on a lever 39, one end of which carries a roller 40 which rests on a cam wheel 41. The mechanism for driving the roller 34 is not shown.

The cam wheel 41 is driven in synchronism with the impression cylinder 44 by a gear wheel 42 on the shaft

Figure 2:
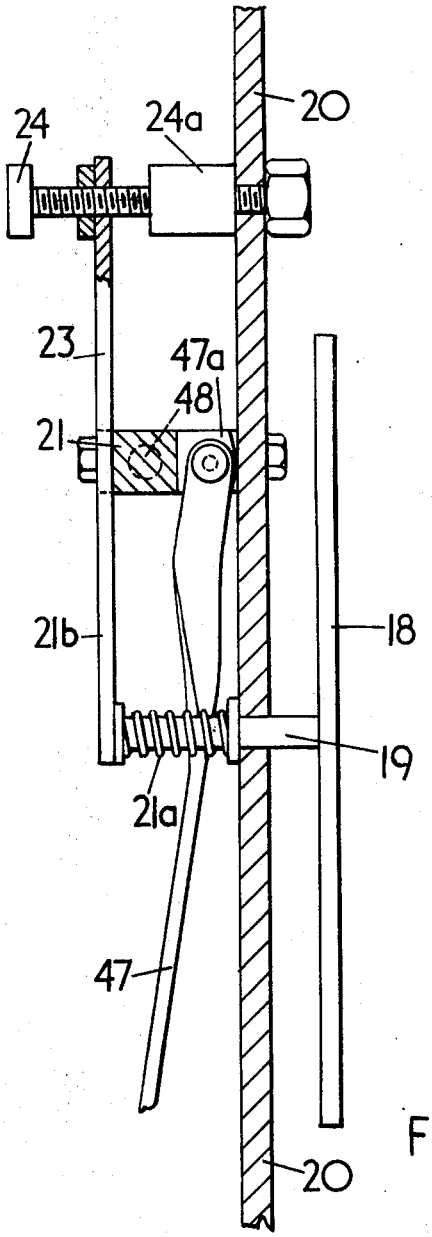
FIG. 2 is a section through the adjusting member and associated parts on the left-hand side of FIG. 1, taken along the line II—II in FIG. 3.

43 of the impression cylinder 44 (the shaft 43 is not shown in FIGS. 1 and 2, for clarity). For a small part of the revolution of the cam wheel 41, the roller 40 enters a depression in the cam wheel 41 and the roller 33 moves towards the roller 34 to form a pinch for the paper 1 and the paper 1 is fed to the impression cylinder 44 to enter the grippers 5. During the rest of the revolution of the cam wheel 41, the roller 40 is lifted and the paper is free to be pulled between the rollers 33 and 34, firstly by the grippers 5 and subsequently by the friction between the blanket and the impression cylinder 44 upon the paper 1.

By adjusting the screw 24, the grippers 5 are moved circumferentially on the impression cylinder 44, and it is therefore necessary to change the timing of operation of the paper feed rollers 33 and 34 to suit the different positioning of the grippers 5. For this purpose, the lever 39 of the cam roller 40 is pivotally mounted on the upper end of a lever 45 pivoted about its centre on a pin 46 and having pivotally connected to its lower end a link 47 pivotally connected at its upper end to a bracket 47*a* on the base 21 of the U-shaped member, as seen in FIGS. 2 and 3. As the screw 24 is adjusted, the upper end of the link 47 moves around pivots 48 projecting from the end of the base 21 and the link 47 is pulled and pushed as indicated by the arrow in FIG. 3. This action moves the lever 45 around its pivot 46, thereby changing the position of the cam roller 40 circumferentially of the cam wheel 41 to adjust the timing of the rollers 33 and 34, to form the pinch between the latter to suit the position of the grippers 5.

By means of the arrangement provided, by operation of the screw 24 while the machine is in operation, the position of the grippers 5 on the impression cylinder 44 is adjusted relative to the blanket on the blanket cylinder, and the corresponding position of the leading edge of the paper 1, and in consequence the position of the imprint on the paper 1, may be precisely adjusted while the machine is in operation.

It is to be understood that the above description is by way of example only, and that details for carrying the invention into effect may be varied without departing from the scope of the invention claimed.

I claim:

1. An offset printing machine comprising:

a master cylinder adapted to hold a master;

a blanket cylinder adapted to hold a blanket;

an impression cylinder adapted to hold a sheet of paper for receipt of an impression transferred thereto from a master on the master cylinder by a blanket on the blanket cylinder;

at least two grippers for gripping the forward edge of a sheet of paper between the blanket on the blanket cylinder and the impression cylinder at each appropriate instant in each cycle of operation of the machine;

a rigid mounting member having said at least two grippers mounted thereon;

means mounting the mounting member on the impression cylinder for movement circumferentially of the impression cylinder to vary the relative position of the sheet of paper and the impression cylinder while the paper cylinder is rotating, to adjust the position of the impression provided by the blanket in the direction of motion of the paper around the impression cylinder;

adjusting means for moving the mounting member circumferentially and retaining the mounting member in a fixed circumferential position with respect to the impression cylinder, the adjusting means being actuable while the impression cylinder is rotating;

a pair of rollers defining a pinch through which each sheet of paper is introduced into said at least two grippers;

a first lever mounting one of the rollers;

a cam follower secured to the first lever;

a circular wheel with a cam depression for moving said first lever to open and close the pinch of the pair of rollers;

means for driving the circular wheel in synchronism with the impression cylinder;

means mounting the cam follower roller for movement in a direction substantially circumferential of the circular wheel;

a second lever connected to the cam follower roller for moving the cam follower roller substantially circumferential of the circular wheel; and means connecting said second lever with said adjusting means;

whereby movement of said at least two grippers circumferentially of the impression cylinder causes a corresponding movement of the cam follower roller substantially in the direction of feed of the paper sheets and the leading edge of each paper sheet is adjusted as the position of the grippers is adjusted.

2. An offset printing machine comprising:

a master cylinder adapted to hold a master;

a blanket cylinder adapted to hold a blanket;

an impression cylinder adapted to hold a sheet of paper for receipt of an impression transferred thereto from a master on the master cylinder by a blanket on the blanket cylinder;

at least two grippers for gripping the forward edge of a sheet of paper for drawing the paper between the blanket on the blanket cylinder and the impression cylinder at each appropriate instant in each cycle of operation of the machine;

a frame for supporting said at least two grippers;

means for mounting the frame on the impression cylinder for movement circumferentially of the impression cylinder to vary the relative position of the sheet of paper and the impression cylinder while the impression cylinder is rotating, to adjust the position of the impression provided by the blanket in the direction of motion of the paper around the impression cylinder;

means for mounting at least one spring for biasing the frame in one direction;

a bar mounted for slidable movement in a longitudinal direction of the impression cylinder;

a non-rotatable plate adjacent one end of the impression cylinder, said bar engaging said plate;

a cam mounted on the bar;

a cam follower on said frame for co-acting with said cam and moving said frame against the action of said at least one spring; and means for adjusting the distance of said non-rotatable plate from the end of the impression cylinder to change the longitudinal position of the bar and in consequence the circumferential position of said at least two grippers relative to the impression cylinder.

3. An offset printing machine as claimed in claim 2, and comprising end plates mounting the cylinders of the machine for rotation, a plurality of pins mounting the non-rotatable plate for movement towards and away from the impression cylinder, the pins passing through bores in one of the end plates, at least one spring urging the non-rotatable plate towards the end plate to move the grippers in one circumferential direction, a U-shaped member comprising arms and base forming a U, the U-shaped member being pivoted about the base of the U for applying pressure on the pins and thereby moving the non-rotatable plate towards the impression cylinder, lever secured to the base of the U, and a manual adjustment screw for adjusting the position of the lever and thereby the circumferential position of said at least two grippers.

4. An offset printing machine as claimed in claim 2, and comprising a bar to which said at least two grippers are attached, means mounting the bar on the frame for rotation about the axis of the bar, means associated with the bar and gripper for opening and closing the grippers upon rotation of the bar, a pinion at one end of the bar, a sector gear mounted on the end of the impression cylinder for pivotal movement, an acutating member for pivoting the sector gear, a stationary cam mounted upon the adjacent end plate of the machine, and a cam follower engaging the cam and mounted on the actuating member.

5. An offset printing machine as claimed in claim 3, and further including a pair of rollers defining a pinch through which each sheet of paper is introduced into said at least two grippers, a pivoted lever mounting one of the rollers, a cam follower connected to the lever, a rotary circular wheel with a cam depression for pivoting the lever to open and close the pinch of the pair of rollers, means for driving the circular wheel in synchronism with the impression cylinder, means mounting the cam follower roller for movement in a direction substantially circumferential of the circular wheel, a lever connected to the cam follower roller for moving the cam follower roller substantially circumferential of the circular wheel, a lever attached to the base of the U-shaped member, and means connecting the lever connected to the cam follower roller to the lever attached to the base of the U-shaped member, whereby movement of the grippers circumferentially of the cam follower roller substantially in the direction of feed of the paper sheets and the leading edge of each paper sheet is adjusted as the position of the grippers is altered by adjusting the adjustment screw.

6. An offset printing machine as claimed in claim 2, in which there are two said cam mounted on the bar, each of which is defined by cam-shaped brackets on the bar, and there are two respective said cam follower members, each of which is a cam follower roller.

7. An offset printing machine as claimed in claim 2, and comprising a pair of compression springs, one end of each of which is housed in a recess in one member of the frame while the other end of each spring is housed in a recess in a projection from the impression cylinder, the compression springs biasing the cam follower member against the cam.

8. A rotary printing machine comprising:

an impression cylinder adapted to hold a sheet of paper;

impression transferring means for holding a master and for transferring an impression from the master to the sheet of paper;

at least two grippers for gripping the forward edge of a sheet of paper for drawing the paper onto the impression cylinder at each appropriate instant in each cycle of operation of the machine;

a rigid mounting member having said at least two grippers mounted thereon;

means mounting the mounting member on the impression cylinder for movement circumferentially of the impression cylinder to vary the relative position of the sheet of paper and impression cylinder while the paper cylinder is rotating, to adjust the position of the impression on the paper in the direction of motion of the paper around the impression cylinder;

adjusting means for moving the mounting member circumferentially and retaining the mounting member in a fixed circumferential position with respect to the impression cylinder, the adjusting means being actuable while the impression cylinder is rotating;

a pair of rollers defining a pinch through which each sheet of paper is introduced into said at least two grippers;

a first lever mounting one of the rollers;

a cam follower secured to the first lever;

a circular wheel with a cam depression for moving said first lever to open and close the pinch of the pair of rollers;

means for driving the circular wheel in synchronism with the impression cylinder;

means mounting the cam follower roller for movement in a direction substantially circumferential of the circular wheel;

a second lever connected to the cam follower roller for moving the camm follower roller substantially circumferential of the circular wheel; and means connecting said second lever with said adjusting means;

whereby movement of said at least two grippers circumferentially of the impression cylinder causes a corresponding movement of the cam follower roller substantially in the direction of feed of the paper sheets and the leading edge of each paper sheet is adjusted as the position of the grippers is adjusted.

9. A rotary printing machine comprising:

an impression cylinder adapted to hold a sheet of paper;

impression transferring means for holding a master and for transferring an impression from the master to the sheet of paper;

at least two grippers for gripping the forward edge of a sheet of paper for drawing the paper onto the impression cylinder at each appropriate instant in each cycle of operation of the machine;

a frame for supporting said at least two grippers;

means for mounting the frame on the impression cylinder for movement circumferentially of the impression cylinder to vary the relative position of the sheet of paper and the impression cylinder while the impression cylinder is rotating, to adjust the position of the impression on the paper in the direction of motion of the paper around the impression cylinder;

means for mounting at least one spring for biasing the frame in one direction;

a bar mounted for slidable movement in a longitudinal direction of the impression cylinder;

a non-rotatable plate adjacent one end of the impression cylinder, said bar engaging said plate;

a cam mounted on the bar;

a cam follower on said frame for co-acting with said cam and moving said frame against the action of said at least one spring; and means for adjusting the distance of said non-rotatable plate from the end of the impression cylinder to change the longitudinal position of the bar and in consequence the circumferential position of said at least two grippers relative to the impression cylinder.

10. A printing machine as claimed in claim 9, wherein the means for adjusting the distance of said non-rotatable plate from the end of the impression cylinder comprises an adjustment member, means mounting the adjustment member for pivotal motion about an axis in a plane normal to the axis of the impression cylinder, and means operatively connecting the adjustment member to the non-rotatable plate, whereby pivotal motion of the adjustment member adjusts the distance of the non-rotatable plate from the end of the impression cylinder.

11. A printing machine as claimed in claim 10, wherein the impression cylinder is mounted for rotation upon spaced end plates of the machine, and comprising a plurality of pins passing through bores defined in one of the end plates and mounting said non-rotatable plate for movement towards and away from the impression cylinder, the adjustment member comprising a member having a base and a plurality of arms projecting therefrom, the arms engaging the pins.

12. A printing machine as claimed in claim 9, and comprising a feed device for introducing each sheet of paper into the grippers, and means connecting the feed device to the means for adjusting the distance of said non-rotatable plate from the end of the impression cylinder, whereby the circumferential position of the leading end of the paper is adjusted as the circumferential position of the grippers is adjusted, the feed device comprising a pair of rollers between the pinch of which each sheet of paper is introduced into the grippers, and means for adjusting the time in the cycle at which the rollers act on the paper to feed it into the grippers, to adjust the circumferential position of the leading end of the paper.

13. A printing machine as claimed in claim 9, and wherein the means for adjusting the distance of said non-rotatable plate from the end of the impression cylinder comprises an adjustment member, means mounting the adjustment member for pivotal motion about an axis in a plane normal to the axis of the impression cylinder, and means operatively connecting the adjustment member to the non-rotatable plate, whereby pivotal motion of the adjustment member adjusts the distance of the non-rotatable plate from the end of the impression cylinder, the printing machine further comprising a feed device for introducing each sheet of paper into the grippers, means for adjusting the circumferential position of the leading edge of the paper fed by the feed device to the grippers, and connecting means connecting the latter adjusting means to the pivotally mounted adjustment member, whereby the circumferential position of the leading edge of the paper is adjusted by the feed device as the circumferential position of the grippers is adjusted.

* * * * *